United States Patent [19]

Williamson et al.

[11] Patent Number: 4,741,461

[45] Date of Patent: May 3, 1988

[54] HOUSING FOR A LIQUID DISPENSER FOR DISPENSING LIQUID SOAP AND THE LIKE

[75] Inventors: Wayne A. Williamson, Warner Robins; George O. Haskell, III; Francis J. Perzinski, both of Macon, Ga.

[73] Assignee: Southern Chemical Products Company, Macon, Ga.

[21] Appl. No.: 541,144

[22] Filed: Oct. 12, 1983

[51] Int. Cl.[4] ..... B65D 25/48

[52] U.S. Cl. ..... 222/181; 222/182; 222/207; 222/214; 222/325; 16/227; 16/267; 16/DIG. 13; 248/223.4; 248/225.1; 292/17; 292/DIG. 38

[58] Field of Search ..... 222/165, 180, 181, 185, 222/325, 182, 207, 214; 16/225, 227, 267, DIG. 13, ; 292/17, DIG. 38; 248/225.1, 223.4

[56] References Cited

U.S. PATENT DOCUMENTS

| | | | |
|---|---|---|---|
| 442,068 | 12/1890 | Markillie | 292/17 |
| 2,059,135 | 10/1936 | Moe | 222/165 |
| 2,427,335 | 9/1947 | Antonia et al. | 222/165 |
| 2,477,014 | 7/1949 | Stanley et al. | 248/223.4 |
| 3,529,798 | 9/1970 | Williams et al. | 248/223.4 X |
| 3,540,687 | 11/1970 | Cuva | 248/223.4 X |
| 3,680,927 | 8/1972 | Neureuther | 16/267 X |
| 3,709,538 | 1/1973 | Seitz et al. | 292/DIG. 38 |
| 4,164,306 | 8/1979 | Perrin | 222/325 X |
| 4,315,345 | 2/1982 | Schijf | 16/267 |
| 4,438,605 | 3/1984 | Delucia | 16/227 |
| 4,515,294 | 5/1985 | Udall | 222/105 |
| 4,570,829 | 2/1986 | Allen | 222/181 |

FOREIGN PATENT DOCUMENTS

| | | | |
|---|---|---|---|
| 402923 | 12/1967 | Australia | 292/17 |
| 1404143 | 5/1965 | France | 16/225 |
| 187313 | 10/1936 | Switzerland | 292/17 |
| 967294 | 8/1964 | United Kingdom | 222/181 |

*Primary Examiner*—Joseph J. Rolla
*Assistant Examiner*—Frederick R. Handren
*Attorney, Agent, or Firm*—Newton, Hopkins & Ormsby

[57] ABSTRACT

A housing assembly has an upright back with side channels which carry a cartridge supporting bracket on which is mounted a removable liquid soap cartridge. A casing hinged at the bottom to the back and snapped to the top of the back, encompasses the cartridge and bracket when the casing is closed. A squeese nozzle connected to the cartridge protrudes out of the bottom of the casing and is activated when a plunger on the casing is depressed toward the bracket to squeeze the nozzle, therebetween.

13 Claims, 3 Drawing Sheets

HOUSING FOR A LIQUID DISPENSER FOR DISPENSING LIQUID SOAP AND THE LIKE

BACKGROUND OF THE INVENTION

1. Field of the Invention

This invention relates to a liquid dispenser and is more particularly concerned with a wall mounted soap dispenser for dispensing liquid soap.

2. Description of the Prior Art

The inventors are aware of the prior art liquid dispenser disclosed in application Ser. No. 363,966, filed Mar. 31, 1982 now U.S. Pat. No. 4,515,294. There is common ownership between that patent application and the current application.

Application Ser. No. 363,966 discloses a liquid dispenser having a flat back plate which hingedly receives a vacuum formed front casing. A cartridge is mounted within the cavity formed by the back plate and the front casing, the cartridge being carried by a bracket mounted on the back plate. A nozzle assembly depending from the cartridge extends between the cartridge carrying bracket and a loosely mounted knob and when the knob is depressed, the liquid soap is dispensed from the nozzle assembly. While this prior art dispenser operates quite satisfactorily, it has quite a number of parts which require considerable labor for assembling the same. Also, the parts require accurate positioning when the device is assembled.

Also in the prior art are other liquid soap dispensers. One such liquid dispenser is known by the trademark SANI-FRESH. This prior art device includes a main housing assembly formed by a rear molded plastic member and front casing. Liquid soap is contained in a plastic bag in the upper end of the housing assembly and a nozzle assembly is permanently affixed to a bag contained within a fiberboard housing. This nozzle assembly has an injection molded nozzle tip within which is a spring loaded check valve. The nozzle assembly also has a depressable tube mounted adjacent to a platen on the inner surface of the forward housing so that an angularly disposed squeeze plate, which is moved forwardly by a lever, can pinch off a portion of the tube and then progressively apply pressure as a lever is brought forward for discharging the liquid which is pinched off in the tube. When the liquid soap is to be replenished, both the nozzle and the housing should be replaced. The nozzle tends to leak and this prior art device is quite complex, being formed of intricate molded parts.

The present invention provides an inexpensive device, the major parts of which are formed from extruded parts which are cut to size. The nozzle assembly of the present invention does not readily leak and the liquid reservoir or cartridge assembly which contains liquid soap can be substituted for the liquid reservoir or cartridge assembly in the two prior art devices described above.

SUMMARY OF THE INVENTION

Briefly described, the present invention includes a housing assembly formed of a back member and a front casing hingedly connected together. The back member includes a flat rectangular back plate, secured in an upright position to a wall, and a pair of opposed channel members which extend along the side edges and open inwardly. The upper and lower ends of the channel members receive the edges of the upper and lower bases of parts of the friction latch and the hinge member. The hinge member and friction latch are substantially identical. Thus, they include forwardly extending flanges which have enlarged cylindrical edges or pins received within the arcuate inwardly opening pin receiving flanges carried by a base mounted on the inside upper and lower surfaces of the casing. The hinge flange is relatively flexible so that the enlarged edge or pin is not readily removed from the confinement of the pin receiving member and, therefore, the front casing will pivot outwardly beyond the limits of pivoting of the hinge. Conversely, the upper friction latch is relatively rigid and, therefore, its pin snaps into place in the associated pin receiving member.

Within the cavity defined by the outer casing and the back plate is a cartridge assembly which includes a reservoir provided with a flexible discharge nozzle assembly which has a central flexible squeeze tube provided with upper and lower check valves. The front plate of the cartridge carrying bracket has, in its central portion, opposed channel members which receive a U-shaped latch which, in turn, removeably receives the nozzle assembly. An elastomeric grommet is press fitted into a hole in the front plate of the casing and carries a moveable plunger assembly which, when depressed will deform the squeeze tube and thereby discharge the liquid soap from the nozzle assembly.

Accordingly, it is an object of the present invention to provide a liquid dispenser which is inexpensive to manufacture, durable in structure and efficient in operation.

Another object of the present invention is to provide a liquid dispenser which can be readily and easily assembled utilizing essentially extruded parts and employing relatively unskilled labor.

Another object of the present invention is to provide a liquid dispenser which will accurately dispense a uniform measured quantity of liquid soap.

Another object of the present invention is to provide a liquid dispenser having few moving parts.

Another object of the present invention is to provide a liquid dispenser which can readily receive new cartridges containing soap and which requires no accurate positioning of a cartridge in order to arrange the cartridge in a position to dispense the liquid soap.

Other objects, features and advantages of the present invention will become apparent from the following description when taken in conjunction with the accompanying drawings.

DETAILED DESCRIPTION OF THE PREFERRED EMBODIMENT

Figure 1:
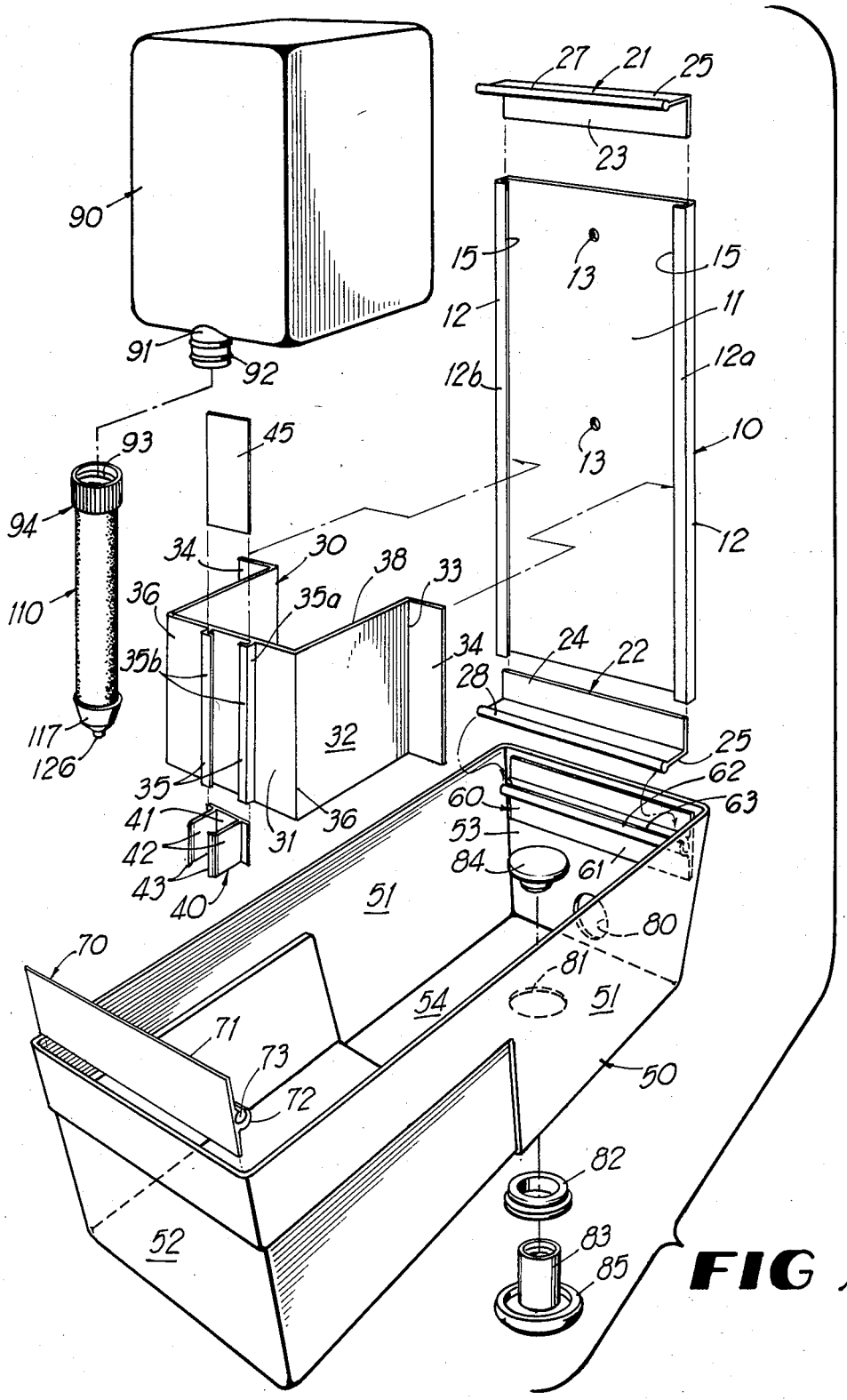
FIG. 1 is a exploded perspective view of a liquid dispenser constructed in accordance with the present invention.

Referring now in detail to the embodiment chosen for the purpose of illustrating the present invention, numeral denotes generally a housing for a liquid containing cartridge assembly, the housing including a back member 10 having a flat rectangular back plate 11 and a pair of opposed, parallel, vertically disposed, inwardly opening, channel members 12. Each of these channel members 12 is L-shaped and includes a pair of parallel, outwardly extending, side flanges 12*a* extending from the edges of back plate 11 and provided at their edges with inwardly turned, opposed, parallel front flanges 12*b*. Thus, the front flanges 12*b* are in spaced parallel opposed relationship to each other and in a common plane parallel to and spaced forwardly from the plane of the back plate 11. The back plate 11 is provided with appropriate holes 13 through which screws (not shown) can be passed so as to secure the back plate flat against a wall or the like. Also, adhesive strips 14, shown in FIG. 2 can be employed for this purpose.

The upper and lower ends of the back member 10 receive respectively, upper and lower casing supporting brackets which form inner elements 21 of the friction latch and the inner elements 22 of the hinge member, respectively. Each bracket 21 or 22 is substantially identical in construction having flat rectangular bases 23 and 24 which are received, respectively, within the upper and lower ends of the recesses 15 defined by the channel members 12. These bases 23 and 24 are glued with adhesive against back plate 11 so that the bases 23 and 24 are fixed with respect to this back plate 11. The inner elements 21 and 22 are both L-shaped members, having forwardly extending flanges or tongues 25 and 26, protruding from the outer or common edges of the bases 23 and 24. The forward ends of the flanges or tongues 25 and 26 are provided with straight cylindrical enlarged pins 27 and 28 which extend the length of the flanges 25 and 26, respectively.

The lower portion of the back member 10 receives for cantilever support, a forwardly extending cartridge supporting bracket, denoted generally by the numeral 30. This bracket 30 includes a rectangular front plate 31 spaced forwardly of the back plate 11, a pair of opposed, generally parallel, side plates 32 which are joined along the side edges 36 to the front plate 31. The side plates 32 are also rectangular having straight rear edges 33 from which protrude the outwardly turned flat rectangular feet 34. The feet 34 are in a common plane with each other, the plane being perpendicular to the planes of the side plates 32 and parallel and offset from the plane of front plate 31.

Front plate 31 is provided with a pair of opposed, upright, L-shaped, channel members 35 which include a pair of spaced parallel vertically disposed side flanges 35*a*, the outer edges of which are provided with inwardly turned spaced opposed parallel front flanges 35*b*. The housing 10 is symmetrical along a vertical plane whereby bracket 30 is a symmetrical member, the L-shaped channel members 35 being spaced inwardly from and parallel to the side edges 36 of the front plate 31. Received within the channels formed by the channel members 35 is a flat rectangular base plate 41 of a nozzle receiving clip denoted generally by the numeral 40. The base plate 41 has, inwardly of its side edges, a pair of forwardly protruding opposed generally parallel tube retaining brackets 42, the outer vertical edges of which are turned inwardly at numeral 43. Thus, the base plate 41 and the opposed parallel brackets 42 form a forwardly opening member for removably receiving the tube of a nozzle to be described hereinafter. The space between the outer surfaces of the opposed tube receiving brackets 42 is approximately equal to the space between the inner edges of the flanges 35*b* so that the outer portions of the base plate 41 can be received beneath the flanges 35*b* as the edges of base plate 41 are received within the channel members 35. A flat rectangular platen plate 45 is inserted into the channels formed by the channel members 35 above base plate 41 so as to be received, flat against the central portion of the front plate 31. The length of plate 45 and base 41 is slightly less than the height of the front plate 31, whereby they form an outer surface along a common vertical plane, the platen plate 45 fixing the position of the clip 40 in the lower portion of the channel members 35 and terminating below the upper edge 38 of the bracket 30.

The feet 34 are approximately the width of the channels 15 and are, therefore, quite readily inserted into the lower portion of the channels 15. Adhesive secures the feet 34 within these channels 15. The upper edge 38 of bracket 30 is in a horizontal plane perpendicular to the plane of the back plate 11 and, therefore, forms a cartridge receiving surface for purposes to be described hereinafter.

The housing of the present invention includes a front casing, denoted generally by the numeral 50. This front casing 10 is a molded or vacuum formed plastic member having a pair of opposed, forwardly converging, side panels 51, a top panel 52 and a bottom panel 53. The top and bottom panels 52 and 53 converge forwardly to terminate in a common plane with the front edges of side panels 51 so that their forward edges are joined to the edges of front panel 54. The lower portion of the front panel 54 and the side panel 51 are offset outwardly with respect to the upper portions thereof.

The casing 50 has the inner edges of panels 51, 52 and 53 terminating in a common plane defining an open end surrounding and received over the back member 10.

The inner hinge element 22 carried by backing member 10 is relatively flexible with respect to the relatively rigid inner element or part of the friction latch. The hinge element or part 22 is of elastomeric material which is flexible and functions to cooperate with a pin receiving member, denoted generally by the number 60. In more detail, the pin receiving member 60, seen in FIGS. 1 and 2, includes a flat rectangular base 61 and a transversely disposed U-shaped, inwardly opening, pin receiving member or journal 62. This pin receiving member 62 is generally arcuate in shape, having a transverse slot or opening 63 throughout its entire length, the opening 63 being more narrow than the inside width of the pin 28. In other words, the member 62 is essentially a hollow tubular member integrally secured to the surface of the plate 61 and having an axially extending slot 63 throughout its length.

The member 60 is secured by adhesive to the inner surface of the bottom plate 53 so that the flange 62 is disposed parallel to and spaced inwardly of the perimeter 57 of the casing 50. The bead or pin 28 of the lower casing supporting bracket or hinge element or part 22 is received within the interior of the pin receiving member 62, the pin 28 being forced through the slot 63 so that it is partially encompassed and journalled for limited rotation within the member 62. Because of the flexibility of the tongue 26, the casing 50 can be tilted forwardly, as shown by the broken lines in FIG. 2, so as to open the housing. Normally, however, the front casing 50 is in a closed vertical position, as shown in full lines in FIG. 2.

For retaining the casing 50 in its closed upright position, the top plate or panel 52 is provided with an outer friction latch element, denoted generally by the numeral 70. This latch element or part 70 is identical in construction to the hinge element or part 60 but functions in a different way as will be explained. The friction catch or latch element 70 includes a flat rectangular base 71 which is identical in shape and size to the base 61 and carries an arcuate, generally tubular, transversely extending catch or pin receiving member 72 which is identical in construction to the pin receiving member 62, there being provided a longitudinally extending slot 73 which is identical to the slot 63. The bead or pin 27 of the upper bracket 21 is of a diameter approximately equal to the inside diameter of the catch 72, but is slightly larger than the width of the slot 73 so that when the casing 50 is disposed in an upright position adjacent to the back member 10, this transverse bead or pin 27 can be received in the generally cylindrical transversely extending opening of the latch 72 or pin receiving member as the casing 50 is urged toward the back member 10.

Figure 2:
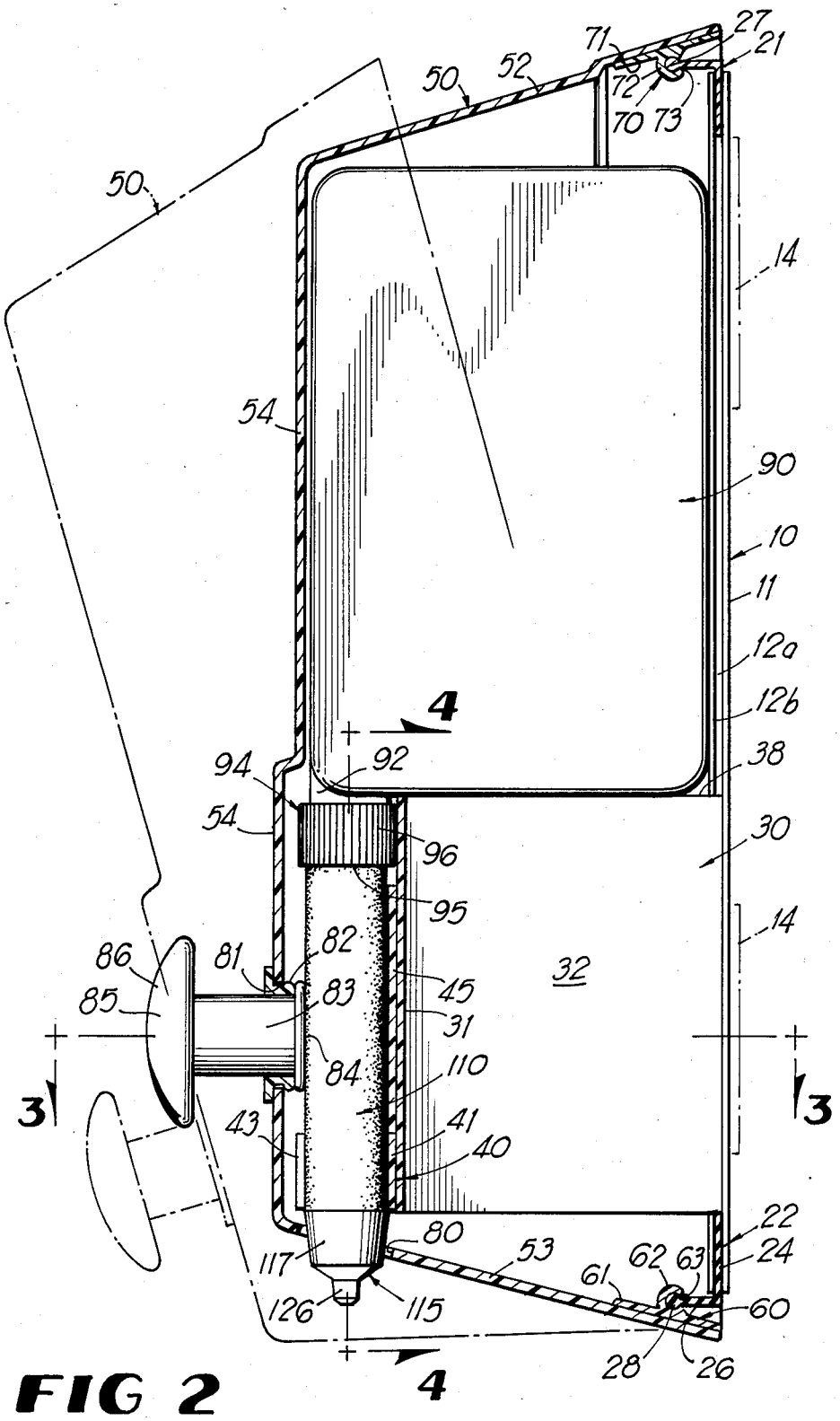
FIG. 2 is a vertical sectional view of the liquid dispenser depicted in FIG. 1.

When the casing 50 is pivoted to its closed, upright position with its open end surrounding the back member 10, the pin 28 of the lower bracket or hinge element 22 pivots within the cylindrical interior of the bead or pin receiving member 62 and the bead or pin 27 is urged through slot 73 and received within the hollow interior of the latch or pin receiving member 72. The open rim of the housing is sufficiently large that it surrounds and encompasses the backing member 10 and the casing 50 is firmly held in place in its closed position, as shown in FIG. 2. When, however, it is desired to open the housing 9, the upper end portion of the casing 50 is mutually grasped and pulled outwardly, thereby, disengaging the element 70 from the element 21 so that it pivots to its broken line position as shown in FIG. 2. When the housing 50 is urged downwardly still more, the flange 26 flexes so as to permit still further opening of the casing, the bracket 22 springing back into place back to its original position when the casing is released.

The bottom plate 53 of the casing 50 is provided with a round opening 80 in its forward central portion and the front plate 54 is provided with a round opening 81 in its lower central portion, the axes or centers of the openings 80 and 81 being in vertical alignment along the vertical centerline of the housing assembly.

Figure 3:
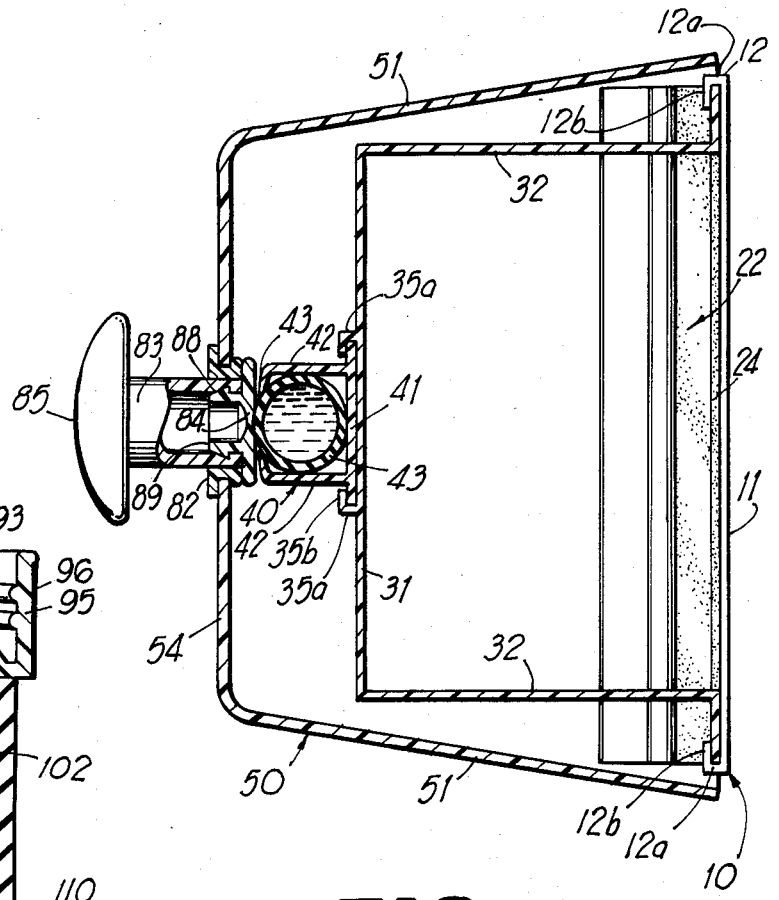
FIG. 3 is a cross-sectional view taken substantially along line 3—3 in FIG. 2.

The hole or opening 81 is provided with a press fitted grommet 82 within which is a plunger assembly which includes a cylindrical shank or plunger 83 having a flat, radially extending, disc-like, pressure applying plate or press plate 84 at its inner end. The outer end of the plunger 83 is provided with a knob 85 having a generally spherical outer surface 86. Since the press plate or pressure applying plate 84 is of larger diameter than the diameter of the hole 81, the plunger assembly is installed by first inserting the grommet 82 in the hole 81 and, thereafter, passing the plunger 83 therethrough. The head on knob 85 is an integral part of the plunger and prevents the plunger 83 from passing inwardly through the hole in the grommet 82. The press plate 84 has a peripheral keeper ring 88 integrally formed on the periphery of its shank 89, as shown in FIG. 3, whereby it can be inserted into the hollow cylindrical inner end of the plunger 83 and will be snap locked in place. Thus, when the plunger 83 is installed, the plate 84 will be positioned on the inside of the casing 50 so that it can be urged toward the knob 85 and thus snapped into place with the retaining ring 88 locking it in a peripherical groove in the end of the plunger 83.

Within the interior defined by the casing 50 and the back member 10, is a cartridge assembly which contains liquid soap to be dispensed. This cartridge assembly includes a hollow cubic or right prismic cartridge denoted generally by the numeral 90. The cartridge 90 has a hollow interior within which is disposed the liquid soap and has a downwardly extending spout 91 which communicates with the interior of the cartridge 90 so that the liquid soap c pass through the spout 91 by gravity. The spout 91 is provided with external threads 92 which received the internal threads 93 of a nozzle assembly, denoted generally by the numeral 94. This nozzle assembly 94 has an upper ball check valve having a hollow, tubular cylindrical coupling member 95 provided along its outer periphery with serrations 96. Coupling member 95 is threaded onto the end of the spout 91.

Figure 4:
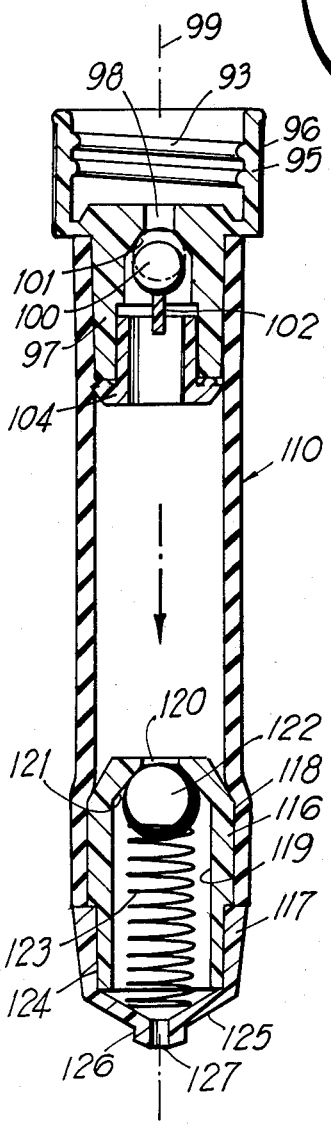
FIG. 4 is a cross-sectional view taken substantially along line 4—4 in FIG. 2.

The lower end portion of the coupling member 95 is of reduced diameter and forms the housing 97 for the check valve. This housing 97 has a smooth outer periphery of smaller diameter than the outside diameter of member 95 and is provided with a tubular passageway 98 along its vertical axis 99. A ball 100 is received within the interior of the housing 97 and seats upwardly against an upwardly converging seat 101. The ball 100 normally is in its open position, as shown in FIG. 4, and is received on a cross bar 102 carried by a retaining plug 104 fitted into the counterbored lower end of the housing 97. The ball 100 seats against gravity onto its seat 101, but is normally in its open position.

Received on the periphery of the housing 97 is a straight, flexible, downwardly extending, hollow squeeze tube, denoted generally by the numeral 110. This squeeze tube 110 is readily deformed to a flattened position when it is desired to dispense the liquid. The lower end portion of this hollow, cylindrical, tubular member 110 receives a lower check valve denoted generally by the numeral 115. The lower check valve 115 includes a pair of opposed telescoping valve housing parts 116 and 117. The upper housing part 116 is a cup-like member having a central passageway 119 and a cylindrical body with an outer periphery 118 and an inner periphery 119. The valve seat 121 of part 116 tapers upwardly to the passageway 120 and a ball 122 is normally urged by a helical spring 123 into a seated position on the seat 121. The lower end portion of the upper housing part 116 is of reduced diameter, as at numeral 124, and receives, thereon, the lower part 117. The lower part 117 has a downwardly tapered bottom 125 with a central discharge nozzle 126 having a passageway 127 therein. The spring 123 acts against the inner surface of the the lower housing part 117 to yieldably urge the ball 122 against its seat 121.

The length of the squeeze tube 110 is approximately equal to the height of the cartridge supporting bracket 30 so that when the nozzle assembly is attached to the cartridge 90 and the cartridge 90 is installed on the upper surface 38 of the bracket 30, the squeeze tube 110 will be received between the brackets 42 and removeably retained therein. The upper check valve 95 is of a diameter slightly larger than the diameter of the squeeze tube 110 and the plate 45 and base 41 space the squeeze tube 110 slightly forwardly so that when the nozzle assembly is in place, the squeeze tube 110 will be appropriately positioned in place. When so installed, the lower housing part 117 of the lower check valve 115 tapers downwardly and passes through the hole 80 so that the nozzle 126 protrudes downwardly on the outside of the lower plate 53. Thus, the nozzle 126 is readily visible, whereby a person can position his hands beneath the nozzle for receiving the liquid soap.

The width of the cartridge 90 is approximately equal to the distance between the forward end portions of the side walls 51 so that when casing 50 is open and the cartridge 90 is placed on the bracket 30, it will be centered by the side walls as the casing 50 is moved inwardly. Furthermore, the distance between the plate 84 and the plate 45 which is transversely opposite to the plate 84 is approximately equal to the width of the squeeze tube 110, in its relaxed position as illustrated in FIGS. 2 and 3. Hence, movement forwardly or rearwardly of the squeeze tube 110 is appreciably arrested and the squeeze tube will remain in its vertical position as shown in FIG. 2. Also, lateral movement of the squeeze tube 110 is arrested, due to the fact that, when the squeeze tube is installed, it is inserted between the brackets 42, as best seen in FIG. 3. The inwardly turned fingers 43 prevent outward movement of the squeeze tube 110 when the casing 50 is pivoted forwardly and downwardly.

In use, when a cartridge 90 and its nozzle assembly have been installed inside the casing 50 and the casing closed, the knob 85 can be depressed in order for a measured amount of liquid soap to be discharged out of the passageway 127 in the nozzle 126, each time the knob 85 is depressed. The depressing of the knob 85 will cause the press plate 84 to move against the central portion of the squeeze tube 110, thereby depressing it to a smaller crosssectional area. This will force the liquid in the squeeze tube 110 upwardly seating the upper ball 100 and also forcing the liquid downwardly through the passageway 120, unseating the normally closed ball 122, and passing the liquid soap through the interior of the housing part 116. Thence, the liquid moves downwardly through the passageway 127. When the knob 85 is released, the resilience of the squeeze tube 110 will return it to its normal cylindrical condition, as illustrated in FIG. 3, thereby returning to its normal shape in which the volumn of the squeeze tube 110 is in its enlarged condition. This will tend to create a vacuum within the squeeze tube 110, permitting the ball 122 to seat against its seat 121 and also permitting the ball 100 to be unseated from its seat 101 thereby enabling the liquid in the cartridge 90 to pass through passageway 98 and thence around the ball 100 and into the squeeze tube 110. Upon again cycling of the plunger 83, an additional measured amount of liquid will be dispensed. When the casing is opened, both the nozzle assembly 94 and the cartridge 90 can be removed quite readily and then the nozzle asembly 94 can be removed from the cartridge 90 and the nozzle assembly 94 installed on a different cartridge. That cartridge 90 can then quite readily be installed on the bracket 30 and the nozzle assembly again installed between the brackets 42.

The structure of the present invention is relatively inexpensive with respect to the prior art soap dispensers, since the structure, with the exception of spring 123, is essentially formed of plastic. The back member 10 is formed of extruded plastic using an inexpensive extrusion die and successive back members 10 cut to length. The same die can be employed for extruding the brackets or elements 21 and 22 which are cut to length; however, different plastic compositions should be employed so that the element 22 is flexible and the element 21 is relatively less flexible. The hinge member 60 and the latch member 70 being identical elements, can also be cut from successive lengths of extruded plastic. Here again, a low cost extrusion die is involved. Both the hinge member 60 and the latch member 70 are of essentially the same width and, therefore, automatic cutting should be employed. Furthermore, the bracket 30 can be extruded since it has an appropriate cross section and can be cut from extruded lengths of plastic. Also, the clip 40 can be cut from an extruded length of plastic.

The assembly of applicant's structure involves only essentially hand assembly of the various elements and gluing the various elements in place. The valves are made from injection molding; however, since these parts are relatively small, they are not expensive to produce. The plunger 83 and its knob 85 and plate 84 can be formed from injection molding.

It is thus seen that the present device is quite inexpensive and yet provides a relatively foolproof, durable structure.

It will be obvious to those skilled in the art that many variations may be made in the embodiment here chosen for the purpose of illustrating the present invention without departing from the scope thereof as defined by the appended claims.

We claim:

1. A housing for a liquid dispenser for dispensing liquid soap and the like comprising:

(a) a back member for being received and held in an upright position against a vertical wall;

(b) a front casing proturuding forwardly from said back member, said front casing having a front panel, a pair of spaced opposed side panels joined by their front edges to said front panel, a top panel joined by its front edge to said front panel, and a bottom panel joined by its front edge to said front panel, the side edges of said side panels, said top panel and said bottom panel being joined so that said front panel, said side panels, said top panel and said bottom panel define an open interior and the rear edges of said side panels, said top panel and said bottom panel define an open rear end for said casing;

(c) a hinge member connecting said bottom panel and back member, said hinge member having bases respectively secured to said back member and said bottom panel, a hinge tongue protruding from one of said bases and a stationary hinge pin carried by said hinge tongue, said hinge pin being of a thickness greater than the thickness of said hinge tongue, the other of said bases carrying an arcuate pin receiving member partially surrounding said pin for confining said pin for limited pivotal movement within said pin receiving member when said casing is moved from an upright closed position, in which said open rear end is adjacent to said back, to an inclined forwardly and upwardly open position;

(d) a friction latch for frictionally joining the upper end portions of said casing and said back member when said casing is in its closed position.

2. The housing defined in claim 1 wherein one of said bases is secured flat against the lower end portion of said back member, said arcuate pin receiving member having a slot extending along substantially the entire length of said member, the width of said slot being greater than the thickness of said hinge tongue.

3. The housing defined in claim 1 wherein said back member includes a back plate and a pair of spaced opposed channel members forming inwardly opening channels, said one of said bases being received between said channel members within said channels, said tongue protruding forwardly from said one of said bases.

4. The housing defined in claim 1 wherein said hinge tongue is elastomeric and said hinge pin is elastomeric, being integrally joined to said hinge tongue.

5. The housing defined in claim 1 wherein said one of said bases and said hinge tongue and said pin are integrally joined together, being an extruded L-shaped member in which the said hinge tongue is joined to its associated base.

6. The housing defined in claim 1 wherein said friction latch includes a first base, a forwardly protruding latch tongue mounted to said first base, a latch pin, carried by of said latch tongue, and a second base mounted on the inside surface of said top panel, said second base having a yieldable arcuate latch element adapted to extend partially around said latch tongue when said casing is in its closed condition, said latch pin being thicker than said latch tongue whereby said latch pin will be held within said latch element and will yieldably be released by said latch element when said casing is urged forwardly.

7. The housing defined in claim 6 wherein said hinge pin and said hinge tongue of said hinge member are respectively substantially identical in construction to said latch pin and said latch tongue of said friction latch.

8. The housing defined in claim 7 wherein said hinge tongue and its base and said hinge pin are integrally joined unitary members formed of an extrusion, said hinge tongue of said hinge member and its associated base being respectively flat rectangular members joined along a common edge and being generally perpendicular to each other, said hinge pin being a cylindrical member extending throughout the length of outer edge of the hinge tongue.

9. The housing defined in claim 8 wherein said latch tongue and said latch pin and the base associated with said latch tongue are integral unitary members and wherein the said latch tongue and its associated base are rectangular members joined along a common edge and said friction pin extends along an outer edge of said tongue, throughout its length.

10. The housing defined in claim 9 wherein said back member includes a flat back plate and a pair of opposed parallel channel members extending forwardly from said back plate, said channel members defining inwardly opening channels respectively receiving the bases of one of said hinge members and one of said latch members.

11. housing defined in claim 10 including a cartridge supporting bracket carried by said back member, said cartridge supporting bracket including a U-shaped member having a rectangular front plate, a pair of opposed side plates connected by their edges to said front plate, and a pair of diverging feet extending respectively into the channels of said channel members, said cartridge supporting bracket being disposed within said casing when said casing is in its closed position, for supporting a cartridge containing liquid soap therein and for receiving along said front plate a nozzle assembly depending from the front portion of said cartridge and means for removably retaining said nozzle assembly in place adjacent to said front plate.

12. The housing defined in claim 11 wherein said means for removably retaining said nozzle assembly in place includes a clip having a flat base and a pair of forwardly extending brackets extending forwardly from said flat base, said front plate having a pair of opposed channel members integrally formed on the front surface thereon and receiving the edges of said flat base, said forwardly extending brackets being spaced from each other sufficiently to receive therebetween said nozzle assembly and having inwardly turned fingers on the outer ends of said forwardly extending brackets.

13. The housing defined in claim 12 including a platen plate received above said clip, a movable plunger assembly carried by said front panel of said casing, said plunger assembly including a plunger loosely carried by said front panel, a press plate carried on the inner end of said plunger and a knob disposed on the outer end of said plunger.

* * * * *